US007296792B2

(12) United States Patent
Kondratuk et al.

(10) Patent No.: US 7,296,792 B2
(45) Date of Patent: Nov. 20, 2007

(54) SELF-VALVING VACUUM DISTRIBUTION FOR A BELT-DRIVEN SHEET CONVEYOR

(75) Inventors: John J. Kondratuk, Kennan, WI (US); Carl R. Marschke, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

(21) Appl. No.: 10/759,262

(22) Filed: Jan. 19, 2004

(65) Prior Publication Data

US 2005/0156376 A1 Jul. 21, 2005

(51) Int. Cl.
*B65H 29/32* (2006.01)

(52) U.S. Cl. ..... 271/197; 271/194; 198/689.1

(58) Field of Classification Search ..... 271/197, 271/196, 194, 276; 198/689.1
See application file for complete search history.

(56) References Cited

U.S. PATENT DOCUMENTS

| | | | | |
|---|---|---|---|---|
| 3,240,491 | A * | 3/1966 | Buccicone | 271/197 |
| 3,272,351 | A | 9/1966 | Burton et al. | |
| 3,827,548 | A | 8/1974 | Matsuo | |
| 3,845,950 | A * | 11/1974 | Kuzniak | 271/194 |
| 4,401,301 | A | 8/1983 | Hayskar | |
| 4,411,420 | A * | 10/1983 | Louis et al. | 271/276 |
| 4,412,738 | A * | 11/1983 | Ahern et al. | 355/76 |
| 4,792,249 | A * | 12/1988 | Lahr | 400/578 |
| 4,997,178 | A | 3/1991 | Ogoda | |
| 5,150,892 | A | 9/1992 | Shimizu | |
| 5,163,891 | A | 11/1992 | Goldsborough et al. | |
| 5,374,021 | A * | 12/1994 | Kleinman | 248/362 |
| 5,564,693 | A | 10/1996 | Elkis et al. | |
| 5,696,690 | A | 12/1997 | Richardson et al. | |
| 6,154,240 | A * | 11/2000 | Hickman | 347/104 |
| 6,254,090 | B1 * | 7/2001 | Rhodes et al. | 271/276 |
| 6,270,074 | B1 * | 8/2001 | Rasmussen et al. | 271/276 |
| 6,371,430 | B1 * | 4/2002 | Vernackt | 248/362 |
| 6,478,725 | B1 | 11/2002 | Bengt et al. | |
| 6,571,702 | B2 * | 6/2003 | Wotton et al. | 101/232 |

FOREIGN PATENT DOCUMENTS

| | | |
|---|---|---|
| DE | 30 01 652 | 7/1981 |
| DE | 3001652 | 7/1981 |
| DE | 199 63 461 | 7/2001 |
| DE | 19963461 | 7/2001 |
| EP | 59-097925 | 6/1984 |
| GB | 1 240 077 | 7/1971 |
| GB | 1240077 | 7/1971 |
| GB | 2 111 647 | 6/1983 |
| GB | 2111647 | 7/1983 |
| JP | 59 0997925 | 9/1984 |

* cited by examiner

*Primary Examiner*—Patrick Mackey
*Assistant Examiner*—Thomas Morrison
(74) *Attorney, Agent, or Firm*—Andrus, Sceales, Starke & Sawall, LLP

(57) ABSTRACT

A self-valving vacuum distribution system for a belt-driven sheet conveyor utilizes the sheets to automatically open vacuum control valves sequentially in a downstream direction as the sheet is carried on the belts. The system also automatically adjusts for varying sheet widths to automatically apply vacuum holding force only to the belt conveyor area covered by the sheet.

9 Claims, 5 Drawing Sheets

SELF-VALVING VACUUM DISTRIBUTION FOR A BELT-DRIVEN SHEET CONVEYOR

BACKGROUND OF THE INVENTION

The present invention relates to systems for processing paperboard sheets, such as container blanks, and more particularly to a vacuum assisted sheet transfer device such as is used, for example, to transfer sheets between the printing stations in a sheet-fed printing system.

As is well known in the art, sheet-fed flexographic printing machines are used for multicolor printing on one side of solid or corrugated paperboard blanks which are subsequently converted into containers or cartons. The blanks are fed through multiple rotary print stations and, typically, into a rotary die cutter at the downstream end. The finished blanks are folded and glued, all in a manner well known in the industry. In order to avoid contact with the freshly printed face of the blanks, the blanks are typically transferred between print stations and between the last print station and the rotary die cutter with vacuum-assisted belt conveyor devices that engage the unprinted face of the blank, usually from above, but may be from below. Since accurate registration of the blanks must be maintained from one print station to the next and into the die cutter, vacuum assisted belt transfer devices must be capable of capturing and transferring the blanks reliably and without loss of register. As a result, large volumes of air are required to induce adequate levels of negative pressure in the areas where sheets are present and, of course, correspondingly large blowers must be used. In addition, the large volume airflow is provided continuously and without regard to sheet length or the spacing between sheets. Vacuum-assisted sheet transfer devices are known in which vacuum generated airflow through the sheet transfer system is controlled laterally to accommodate sheets of varying width, but such devices are typically mechanically complex.

Therefore, it would be desirable to have a vacuum distribution system for a belt conveyor sheet transfer device that applies vacuum only when and where a sheet is present, to thereby minimize air volume loss and to permit the use of smaller blowers.

SUMMARY OF THE INVENTION

In accordance with the present invention, a self-valving vacuum distribution system for a belt operated sheet transfer conveyor applies sheet holding vacuum precisely and only where the sheet is located, both in the machine direction and in the cross machine direction. The vacuum that follows the moving sheets actuates the vacuum control valves such that they open to provide vacuum only beneath the advancing sheet and not beyond the lateral edges of the sheet.

The self-valving vacuum distribution system of the present invention comprises a vacuum plenum that has a flat surface over which a pair of spaced conveyor belts operate to define with the surface an open vacuum channel section; and, vacuum control valves that are spaced along the channel in the plenum surface and which are held closed by a high pressure differential between the vacuum plenum and the open vacuum channel and are biased to open under a reduced pressure differential between the vacuum plenum and the vacuum channel when the channel is covered by a sheet carried over the channel on the conveyor belts. The apparatus preferably includes a vacuum starter opening in the plenum surface upstream of the control valves to provide initial vacuum communication between the plenum and the upstream end of the vacuum channel. The apparatus preferably operates with an infeed device adapted to move a line of spaced sheets in series into contact with the conveyor belts to cause the leading edge of each sheet to override the vacuum starter opening and each control valve in succession, thereby progressively closing the vacuum channel and reducing the pressure differential to said reduced level allowing the valves to be biased open.

When operating to process a line of spaced sheets, passage of the trailing edge of each sheet over the control valves causes the valves to progressively close. The conveyor belts preferably have flat coplanar conveying surfaces, and the plenum surface between the belts is recessed from the conveying surfaces to form the vacuum channel.

In a presently preferred embodiment, each of the control valves comprises a flat resilient metal plate operatively connected by an edge to the plenum surface and having a closure face bent to curve away at an acute angle from the plane of the surface to provide the bias to open at said reduced pressure differential, and a vacuum opening in the plenum surface that provides vacuum communication between the plenum and the vacuum channel, said vacuum opening aligned with the valve plate and closed thereby at the high pressure differential.

In the preferred embodiment of the invention, the apparatus includes a plurality of laterally adjacent vacuum channels, each channel providing support for an incremental width of the sheet, and the vacuum plenum is operatively connected to the adjacent vacuum channels. In the presently preferred embodiment, each of the control valves includes a vacuum opening in the plenum surface that provides vacuum communication between the plenum and the vacuum channel, and a valve plate that is attached to the plenum surface and is operative to seal the vacuum opening against the valve bias at the high pressure differential. This supply of plenum vacuum to the starter openings may be provided by a starter vacuum conduit that is controlled by the control valve to provide the plenum vacuum pressure to the starter opening of the next laterally adjacent vacuum channel when the sheet is wide enough to cover that next adjacent channel. The starter vacuum conduit preferably includes a vacuum inlet end in the plenum surface and a vacuum outlet end having an open connection to the vacuum starter opening in the next adjacent vacuum channel, and wherein the valve plate is operative to close the vacuum inlet end at the high pressure differential and to open the inlet end at the reduced pressure differential. A starter vacuum conduit is provided to connect the plenum surfaces of each pair of laterally adjacent vacuum channels.

In a variation of the present invention, a sheet-actuated vacuum assisted sheet conveyor comprises a pair of laterally spaced, coplanar, parallel driven flat conveyor belts positioned to operate over a surface of a vacuum plenum, the plenum surface between the belts being recessed from the coplanar flat belts to define a shallow vacuum channel, a plurality of vacuum control valves are located in the vacuum surface spaced in the direction of conveyor belt movement and provide vacuum communication between the plenum and the vacuum channel. The control valves are operative to be held closed by a negative pressure in the plenum sufficient to create a first pressure differential across the valve when no sheet is present. The valves are biased to open for vacuum communication when a sheet is present at a second pressure differential across the valve less than the first pressure differential. Means are provided for moving sheets into planar contact with the conveyor belts in a manner that progressively covers the vacuum channel. Means are also provided for applying the plenum vacuum to an upstream end of the vacuum channel, upstream of the upstreammost valve, such that, as a sheet moves to progressively cover the vacuum channel, vacuum pressure in the channel moves in the downstream direction with the sheet to cause the pressure differential across each valve in succession to decrease to the second pressure differential, causing the valves to serially open, thereby applying the plenum vacuum directly to the sheet to hold the same against and to move with the conveyor belts. The foregoing variant of the invention also utilizes vacuum control valves which comprise a vacuum opening in the plenum surface of the vacuum channel, and a valve plate that is attached to the plenum surface and is operative to seal the vacuum opening against the valve bias at the first pressure differential. The valve plate preferably comprises a thin spring steel plate attached at one edge to the plenum surface and permanently bent along a hinge line to define a flat body portion extending away from the surface at an acute angle when the valve is open.

The means for applying the plenum vacuum pressure to the upstream end of the vacuum channel preferably comprises a vacuum starter opening in the plenum surface. The preferred apparatus also includes a plurality of laterally adjacent vacuum channels that are operatively connected to the vacuum plenum, each channel providing support for an incremental width of the sheet. The vacuum starter opening of each of the laterally adjacent vacuum channels is connected by a starter vacuum conduit to a directly adjacent vacuum channel such that the plenum vacuum pressure in said directly adjacent channel, when the control valve for that directly adjacent channel is open, is communicated to the starter opening of the laterally adjacent channel. Each starter vacuum conduit includes a vacuum inlet end in the plenum surface of the directly adjacent vacuum channel under the reed valve.

In accordance with the method of the present invention, the vacuum assisted transfer of the sheets delivered in serial spaced relation is performed in accordance with the steps of (1) driving a pair of laterally spaced coplanar parallel flat conveyor belts over a surface of a vacuum plenum with the plenum surface between the belts recessed to define a shallow vacuum channel, (2) positioning a plurality of vacuum control valves in the vacuum surface with the valves spaced in the direction of conveyor belt movement and providing fluid communication between the plenum and the vacuum channel, (3) holding the valves closed by generating a negative pressure in the plenum sufficient to create a first pressure differential across the valves, (4) biasing the valves to open for fluid communication at a second pressure differential across the valves less than the first pressure differential, (5) moving the sheets into planar contact with the conveyor belts to cause each sheet to progressively cover the vacuum channel, (6) applying a starter vacuum pressure to an upstream end of the vacuum channel upstream of the upstreammost valve, and (7) utilizing the moving sheet to progressively cover the vacuum channel, causing the (a) the vacuum pressure in the channel to move downstream with the sheet, (b) the pressure differential across each valve to decrease in succession to said second pressure differential, and (c) said valves to serially open, thereby applying the plenum vacuum pressure to the sheet to hold the sheet against and to move with the conveyor belts.

The method also preferably includes the steps of (1) providing a plurality of laterally adjacent vacuum channels, (2) utilizing the adjacent channels to provide support for incremental widths of the sheet, and (3) transferring the negative plenum pressure from the vacuum channel to which the starter vacuum is applied to the upstream ends of the laterally adjacent vacuum channels serially in response to the opening of each respective control valve.

DETAILED DESCRIPTION OF THE PREFERRED EMBODIMENT

Figure 1:
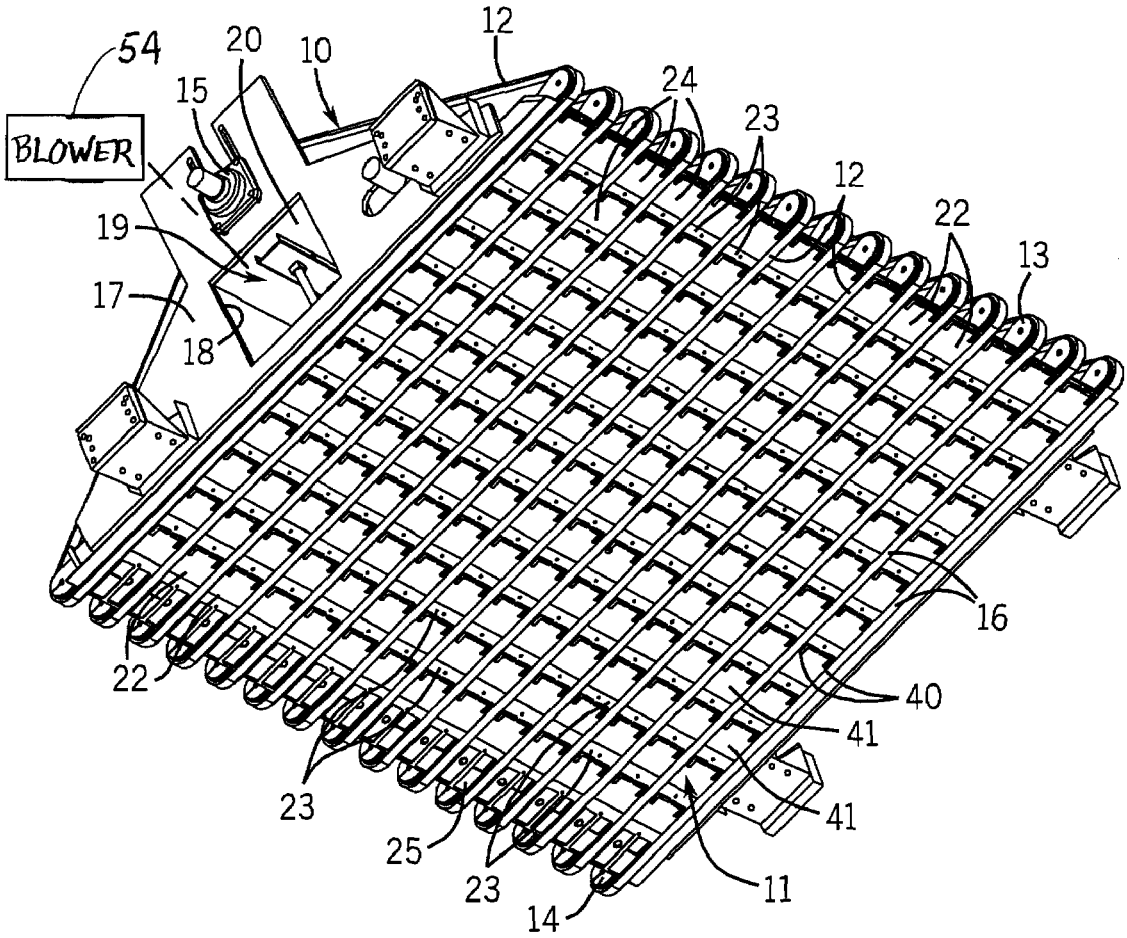
FIG. 1 is a bottom perspective view of a sheet transfer apparatus of the present invention.

Referring first to FIG. 1, there is shown a sheet-actuated, self-valving vacuum transfer device for handling sheets delivered in serial spaced relation. It should be noted, however, that the apparatus of the present invention may also be used to drive or convey a continuous web of material. Nevertheless, the primary function of the apparatus of this invention is to transfer sheets, such as corrugated paperboard box blanks, from one station to another in a converting process. For example, the corrugated sheets may be transferred from one flexographic print station to the next in a manner that avoids any contact with the freshly printed face of the sheets. Thus, as is well known in the art, sheets are captured by and transferred along the underside of a vacuum plenum over the surface of which operate two or more conveyor belts to move the sheets horizontally while the vacuum force holds the sheets tightly to prevent loss of register. The present invention, however, utilizes a unique sheet-actuated valving system that applies vacuum only to the area of the plenum surface covered by the sheet, thereby minimizing vacuum loss and reducing blower requirements.

The plenum 10 has a lower plenum surface 11 which is of a layered sandwich construction as will be detailed hereinafter. A series of laterally spaced conveyor belts 12 are each mounted to operate over the plenum surface 11 between a head pulley 13 and a tail pulley 14, with the return runs of the belts operating around an upper drive roll 15. The belts have flat outer conveying surfaces 16 and toothed inner surfaces in the manner of timing belts. The drive roll 15 is hobbed or otherwise machined with a tooth profile to provide positive driving engagement with the toothed belts 12. A drive motor 29, operatively connected to the drive roll 15, is mounted inside the plenum 10. The plenum 10 is mounted between a pair of laterally opposed end plates 17, one of which is provided with a large opening 18 which is connected with appropriate ducting (not shown) to a blower (also not shown) having a capacity sufficient to at least generate a negative vacuum pressure in the plenum of about three inches of water (about 0.75 kPa) with a maximum width sheet fully engaged. The plenum includes a long central supply chamber 20 connected along each of its lower edges to shallow distribution chambers 21 extending in upstream and downstream directions and defining with the lower plenum surface 11 a plenum chamber 19.

The flat conveying surfaces 16 of the conveyor belts 12 are coplanar and define the plane of the lowermost surface of the sheet transfer apparatus. Each adjacent pair of conveyor belts 12 and the plenum surface 11 therebetween define a shallow vacuum channel 22 that runs the full length of the apparatus between the head and tail pulleys 13 and 14. Each of the vacuum channels 22 (there being sixteen in the apparatus shown) is divided by common laterally extending divider strips 23 into a series of vacuum channel sections 24 (there being eleven vacuum channel sections 24 in each vacuum channel 22 in the disclosed embodiment). The row of upstreammost channel sections are starter vacuum channel sections 25, the construction and function of which will be described.

Figure 2:
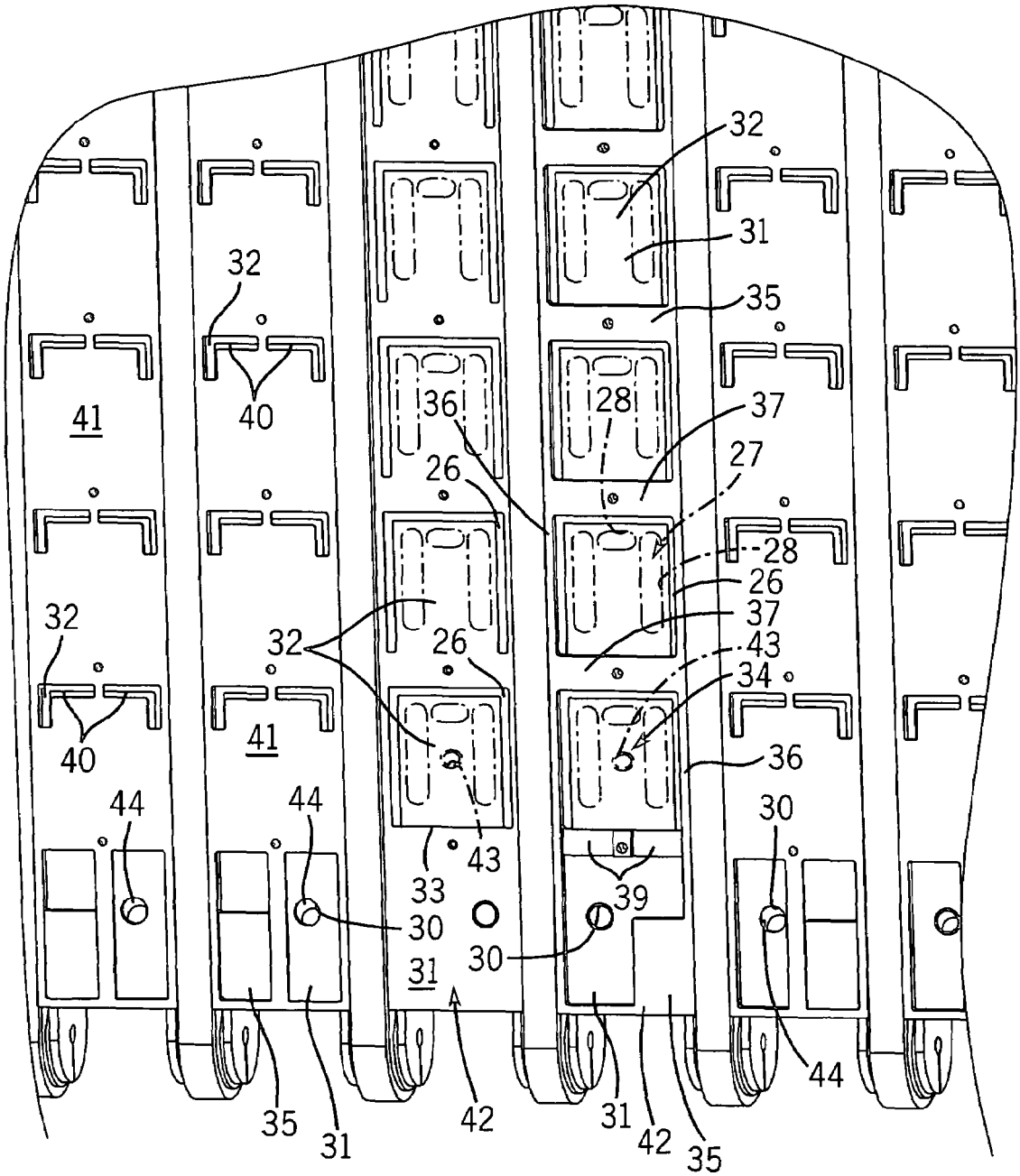
FIG. 2 is an enlarged view of a portion of FIG. 1 with layers of the operative plenum surface broken away to show the construction thereof.
Figure 3:
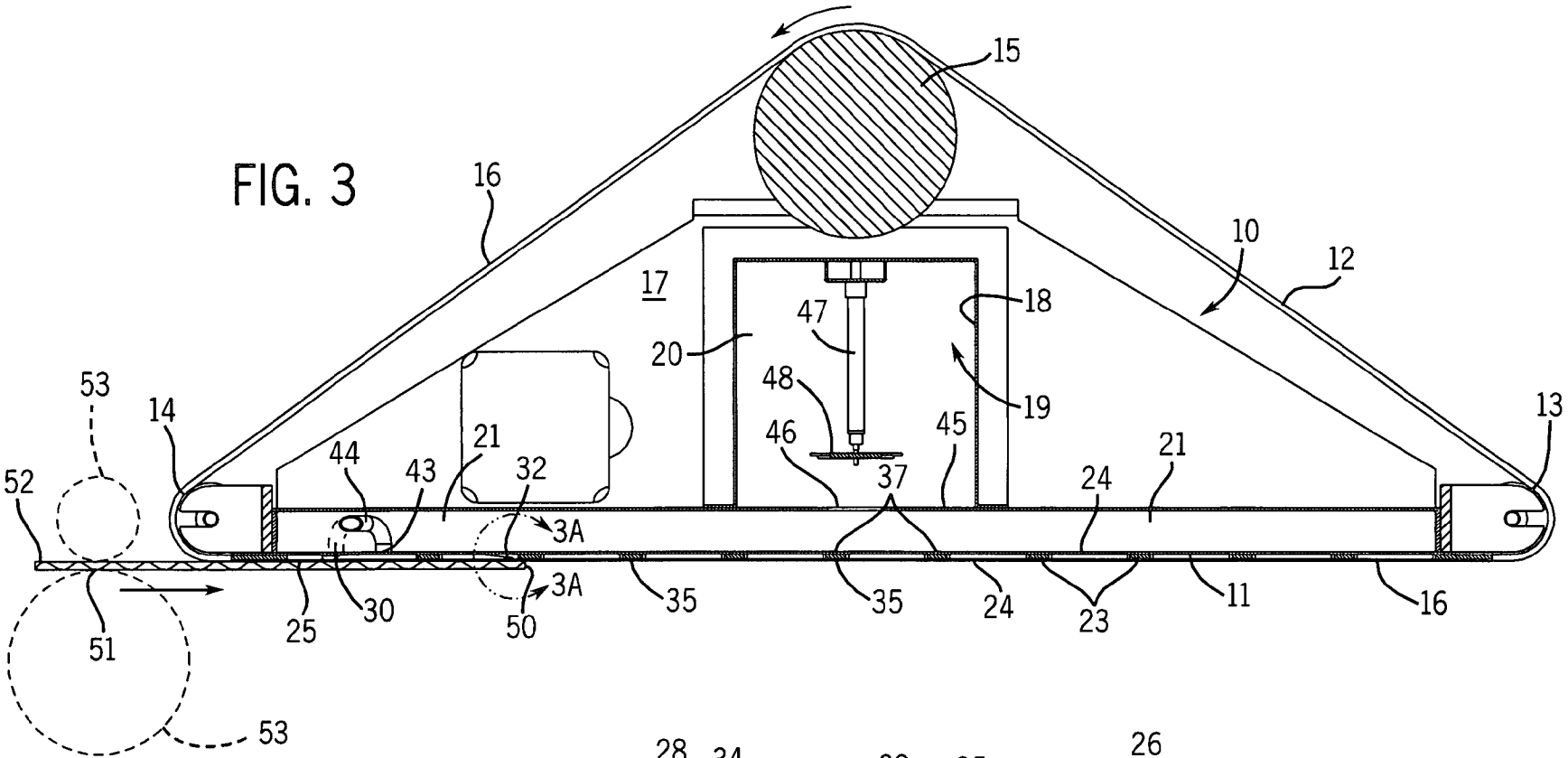
FIG. 3 is a vertical section taken on line 3-3 and including a corrugated paperboard sheet positioned to show schematically the self-valving feature of the present invention.

Referring also to FIGS. 2 and 3, the construction of the plenum surface 11, the vacuum channels 22 and the various vacuum channel sections 24 and 25 will now be described. The multi-layer construction of the plenum surface 11 includes an innermost layer that comprises the lower wall 26 of the plenum chamber 19 and extends completely over the underside of the sheet transfer apparatus. The plenum chamber lower wall 26 preferably comprises an 11 gauge (0.125 in or 3.2 mm) steel sheet. The wall 26 is provided with parallel lines of vacuum openings 27, each line of openings corresponding to a vacuum channel 22. In the embodiment shown, the vacuum openings 27 comprise a U-shape arrangement of slots 28. Each arrangement of vacuum opening slots 28 lies within a vacuum channel section 24 in the completed plenum surface. The upstream end of each line of vacuum openings is provided with a vacuum starter opening 30 that provides vacuum communication from the interior of the plenum chamber 19 to the starter vacuum channel section 25 at the upstream end of the vacuum channel 22, as will be described in more detail below. Overlying each line of vacuum openings 27 and the respective starter opening 30 is a spring steel strip 31 which may have a thickness of 0.008 in (0.2 mm). At the location of each of the vacuum openings 27, the strip 31 is cut to define a U-shaped valve plate 32 that operates in the manner of a reed valve. Each valve plate 32 is permanently bent to curve along a hinge line 33 and extend away from the plenum lower wall 26 at an acute angle. Thus, each group of vacuum opening slots 28 and the overlying valve plate 32 comprises a normally open vacuum control valve 34.

Overlying each steel strip 31 is a spacer grid 35 which may have a thickness of about 0.25 in (about 6.4 mm). Each spacer grid 35 includes continuous lateral edges 36 which run the full length of the sheet transfer apparatus and are spaced laterally from the edges of the next adjacent spacer grid to define guide slots for the toothed faces of the conveyor belts 12. The spacer grids 35 also include laterally extending connector strips 37 which comprise the divider strips 23 that define the cross machine direction rows of vacuum channel sections 24 and the upstream row of starter vacuum channel sections 25. A slider plate 41 is placed over each of the spacer grids 35 to provide a low coefficient of friction surface for the conveyor belt edges and for the surface of the paperboard sheet 51 that is being carried on the surface 16 of the belts 12. The slider plate may have a thickness of about 0.0625 in (about 1.6 mm). In the final assembly, the exposed surface of the slider plate 41 is recessed from the conveying surfaces 16 of the belts 12 by about 0.050 in (about 1.3 mm). The conveyor belts 12 may be spaced laterally from one another by about 5 in (about 125 mm), thereby defining the long shallow vacuum channels 22 running the full length of the sheet transfer apparatus. Each slider plate 41 includes a pair of L-shape vacuum communication slots 40 for each of the vacuum channel sections 24. When the vacuum control valve 34 is open, the vacuum communication slots 40 allow plenum vacuum to be supplied to the vacuum channel sections and thus to a sheet being carried over it, as will be described in greater detail below.

Figure 4:
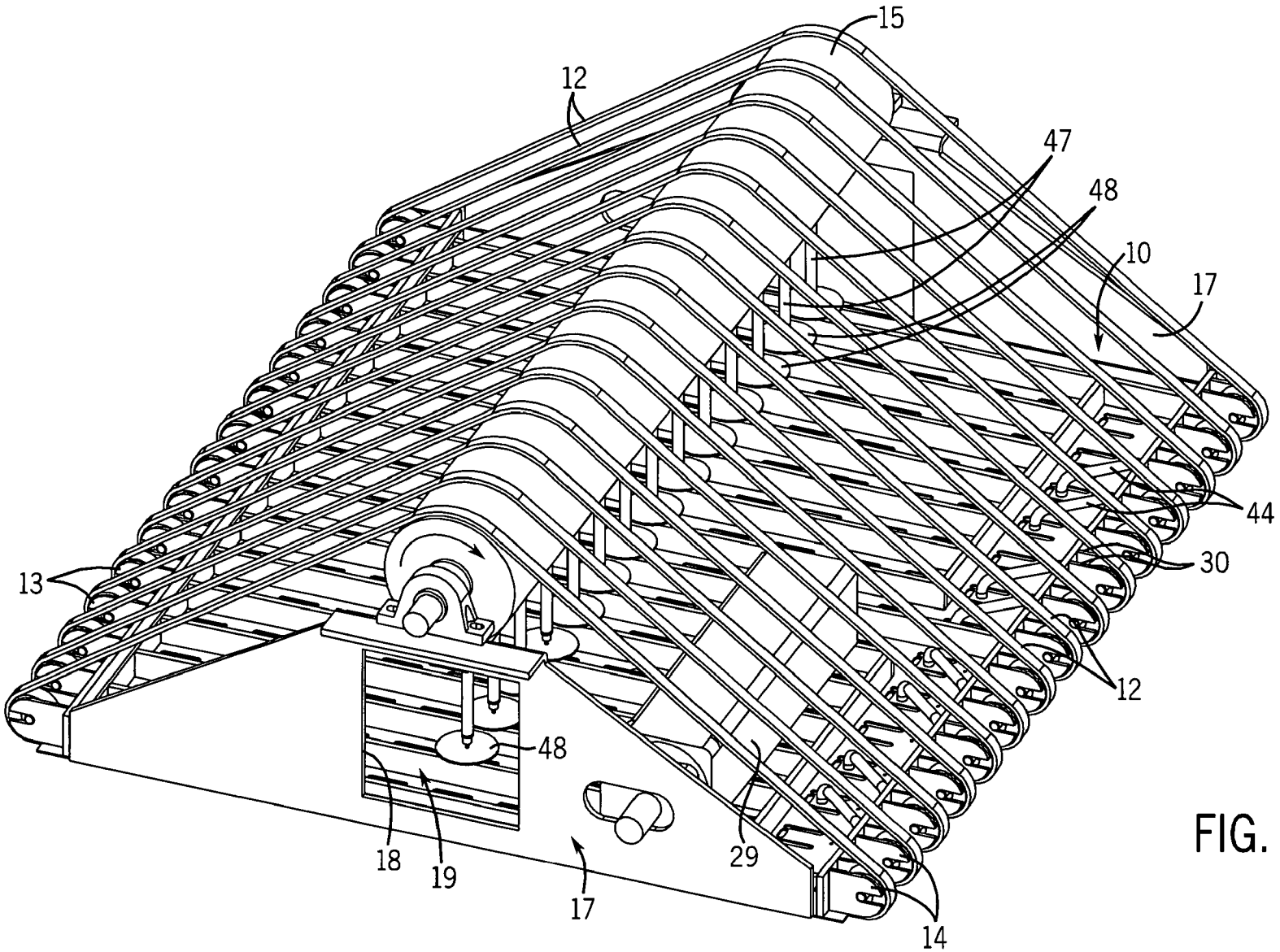
FIG. 4 is a top perspective view of the apparatus shown in FIG. 1 with the top portion of the vacuum plenum removed to show the interior construction.

A pair of adjacent vacuum channels 22 at the center of the apparatus comprise the main vacuum channels 42. The vacuum starter opening 30 at the upstream end of each of these channels is always in direct open communication with the plenum chamber 19. At the center of the arrangement of vacuum opening slots 28 in the first row of vacuum channel sections 24, the plenum wall 26 is also provided with a vacuum inlet opening 43. The vacuum inlet opening 43 in each of the main vacuum channels 42 is connected by a vacuum conduit 44 to the vacuum starter opening 30 of the next laterally adjacent vacuum channel 22, as best seen in FIG. 4. In a similar manner, each of said laterally adjacent vacuum channels 22 includes a vacuum inlet opening 43 which is connected with a starter vacuum conduit 44 to the vacuum starter opening 30 of the next adjacent vacuum channel in a manner that repeats laterally outwardly in both directions from the main center vacuum channels 42. However, it has been found that the cross machine direction propagation of vacuum pressure through a vacuum conduit 44 from one vacuum channel 22 to the next adjacent vacuum channel results in a delay of about 20 milliseconds for the next laterally adjacent valve to open. Because a delay of about 40 milliseconds is believed to be the maximum allowable at anticipated sheet speeds, it is preferable to provide separate starter openings 30 in every third vacuum channel 22 in the cross machine direction. In this manner, the maximum valve opening delay would be limited to 40 milliseconds. This modification will be described in greater detail below.

Figure 5:
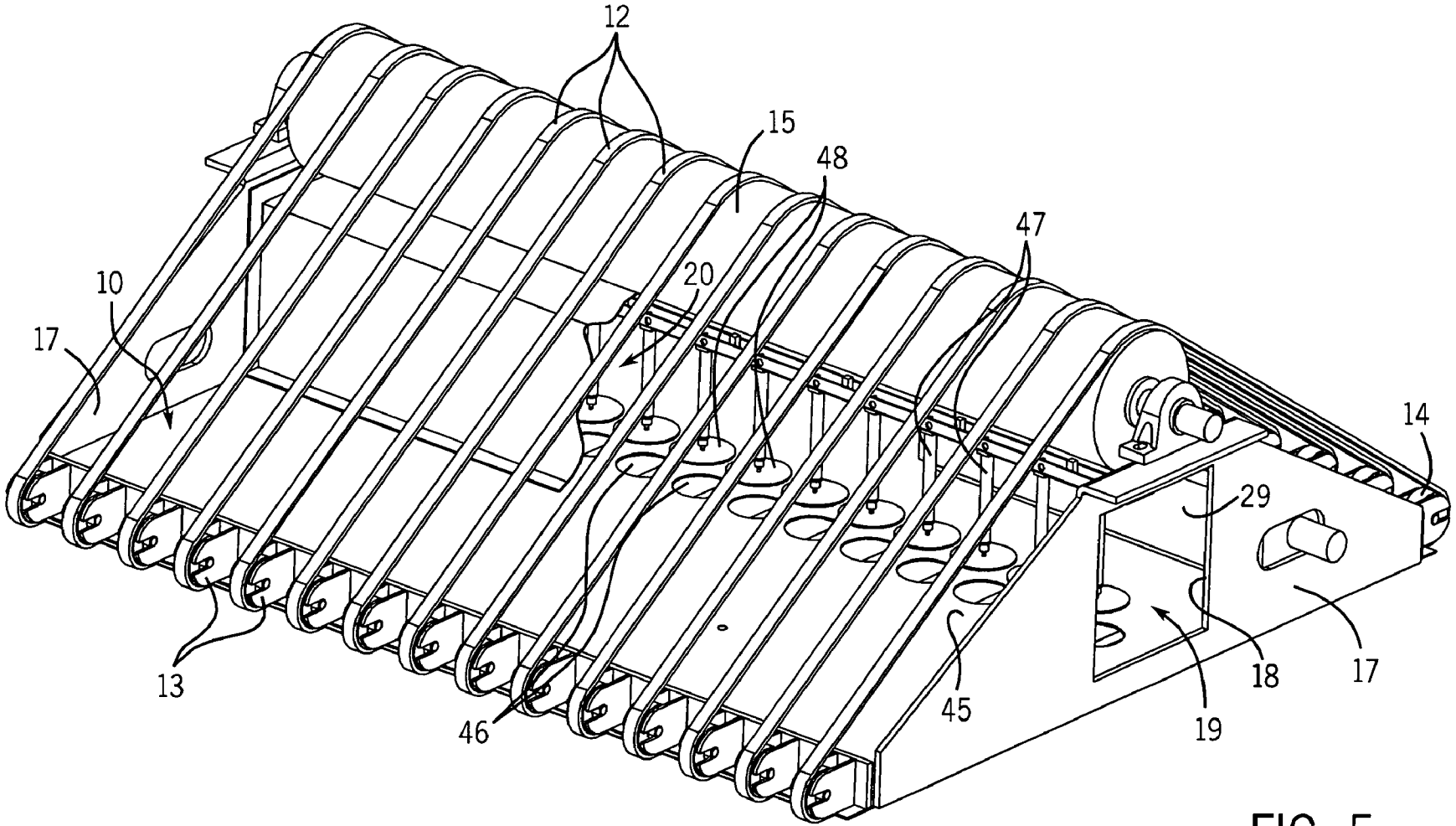
FIG. 5 is a top perspective view of the apparatus shown in FIGS. 1 and 4 with a portion of the vacuum plenum broken away to show details of the interior construction.

As best seen in FIG. 5, the vacuum supply chamber 20 is separated from the vacuum distribution chamber 21 by a chamber bottom plate 45. The bottom plate is provided with a row of airflow openings 46 which may be equal in number to the number of vacuum channels 22, but may comprise a larger or smaller number of openings. Air flow through the openings 46 is controlled by a series of pneumatic cylinders 47 each of which operates an air flow valve 48 to selectively and independently open or close its air flow opening 46.

Figure 3A:
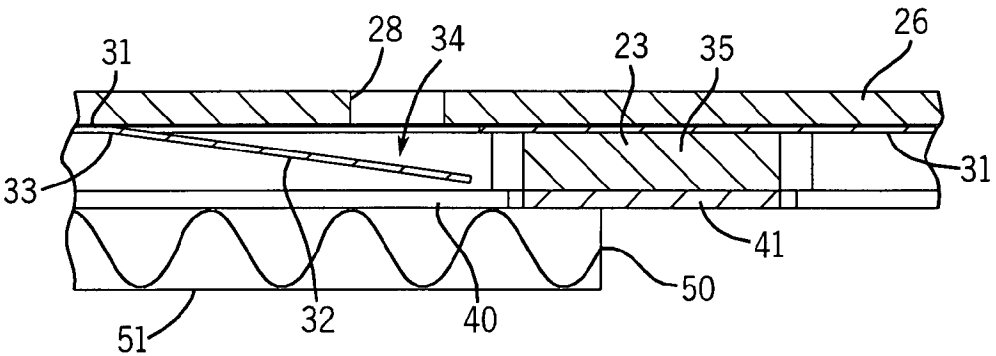
FIG. 3A is an enlarged detail taken on line 3A-3A of FIG. 3.

In operation, a negative vacuum pressure is generated in the vacuum plenum in stages. Because all of the vacuum control valves 34 are biased open, the large open flow area would make it difficult to initially evacuate the plenum with a blower having a capacity sized for normal operation. Therefore, the air flow openings 46 in the bottom plate 45 of the vacuum supply chamber 20 are all closed by operating the pneumatic cylinders 47 to close the air flow valves 48. When the vacuum in the supply chamber 20 has reached a desirable level, the air flow valves 48 may be opened in sequence to permit the evacuation of the plenum chamber 19 in a controlled manner. The valve plates 32 of the vacuum control valves are constructed such that, when the pressure differential across the valve (i.e., between the plenum chamber 19 and the vacuum channels 22) reaches a desired level, for example 3 in of water (0.75 kPa), the valve plates 32 will be sucked against the plenum lower wall 26, closing the vacuum control valves 34. In this state, the apparatus is ready to receive and transfer sheets which may, for example, be exiting and under the control of the print rolls 53 of an upstream printer. As is best seen in FIGS. 3 and 3A, with the valve plates 32 held closed by the vacuum in the plenum chamber 19, vacuum is initially applied only to the vacuum starter openings 30, including two central vacuum starter openings 30 and each third opening in opposite cross machine directions. As the lead edge 50 of the sheet 51 moves over the starter openings 30, the shallow vacuum channel 22 will begin to be covered by the sheet in the direction of sheet movement and the negative pressure in the plenum will begin to propagate in the downstream direction. The pressure reduction in the starter vacuum channel section 25 progresses with downstream movement of the lead edge 50 of the sheet into the first vacuum channel section 24, with negative pressure transfer facilitated by vacuum transfer slot 39 in the spacer grid 35. As soon as the pressure drop in the first vacuum channel section 24 reaches a predetermined level, the pressure differential across the control valve 34 is reduced to a level where the vacuum pressure in the plenum chamber 19 is no longer able to hold the valve plate 32 against its preset spring bias and the valve will begin to open. As soon as the valve plate 32 begins to open and/or the sheet continues to move downstream, vacuum supplied directly from the plenum causes the differential pressure to decrease until the static vacuum in the vacuum channel section 25 is very close to plenum vacuum pressure, thereby providing virtually full plenum suction to hold the sheet against the conveyor belts 12. As the sheet progresses downstream, it progressively covers the vacuum channel sections 25 and the vacuum supplied to the covered channel will continue to move with the moving sheet downstream causing the control valves in each vacuum channel section covered by the sheet to open sequentially to apply plenum vacuum to hold the moving sheet securely on the conveyor belts 12. Channel vacuum travels along the shallow space (e.g. 0.050 in deep) between the face of the sheet and the slider plate 41 recessed from the surface 16 of the belts 12. Each of the control valves 34 will remain open and apply plenum vacuum to the sheet as long as the sheet overlies the valve. Thus, the apparatus of the present invention could be used to apply a driving force to a continuous web operating thereover. However, the primary intended application of the sheet holding apparatus is to convey sheets that are delivered in spaced serial relation. In this primary intended application, as the tail edge 52 of a sheet passes over the vacuum communication slots 40, the vacuum in the vacuum channel section 25 is lost and the differential pressure across the control valve 34 increases to the high initial level, pulling the valve plate 32 over the vacuum openings 27 to close the valve. The system is, therefore, self-valving with the advancing sheets activating the vacuum control valves 34 to open and then permitting them to close as the tail edge of the sheet passes over the valves. In order to maintain vacuum holding force on the sheet as long as possible, the vacuum communication slots 40 in the slider plate 41 are positioned at the downstream end of each vacuum channel section 25. Thus, the vacuum holding force is not lost until the tail edge 52 of the sheet 51 passes the vacuum communication slots 40 and is moving onto the next downstream vacuum channel section 25 or the next machine element, such as a die cutter. This feature reduces the minimum sheet length that the apparatus will adequately convey.

The apparatus and method of the present invention also provide automatic cross machine direction vacuum adjustment to accommodate sheets of varying widths. As indicated previously, a sheet 51 entering the apparatus from upstream will pass over and cover the vacuum starter openings 30 and vacuum will build up in the starter vacuum channel sections 24 and be carried with the sheet to the vacuum channel sections 25 and the first control valves 34 which will open as indicated above. When the valve plate 32 lifts to open the valve, vacuum pressure in the vacuum channel 22 will enter the vacuum inlet opening 43 and communicate via the starter vacuum conduit 44 to the vacuum starter opening 30 of the next adjacent vacuum channel 22. If an incremental width of the sheet is sufficient to cover that next adjacent starter vacuum channel section 24 and vacuum starting opening, the vacuum will build up in the channel and travel downstream with the lead edge 50 of the sheet 51 to cause the vacuum control valves 34 in that machine direction line of valves to sequentially open. If there is no incremental width of the sheet sufficient to cover an adjacent vacuum channel 22, there will be no vacuum build up in the channel and the control valves 34 will simply not open. In other words, the incremental increase in sheet width must be sufficient to extend in the cross machine direction onto the next belt surface. Thus, the system is automatically self-adjusting in the cross machine direction, as well as in the machine direction.

The apparatus and method of the present invention provide a substantial advantage over prior art devices insofar as a much lower volume of vacuum airflow is necessary, thus substantially decreasing the required blower horsepower and the noise generated by blower operation. The vacuum air flow is held to an absolute minimum and, as a further beneficial result, the reduced air flow will not tend to dry the ink on the print plates or on the anilox rolls as compared to prior art vacuum transfer apparatus. The wider the sheets being conveyed, the more valves there will be in the cross machine direction with inherent vacuum leaks at the lead and tail edges of the sheet. The vacuum supply must be sufficient to maintain the minimum vacuum pressure (e.g. 3 inches of water or 0.75 kPa) when handling maximum size sheets.

In lieu of a control valve 34 utilizing a thin spring steel valve plate 32, a control valve may be utilized that comprises a spring biased poppet type valve mounted inside the plenum chamber 19. This type of valve would, for example, include a coiled compression spring surrounding the valve stem and providing a bias that would cause the valve to open when there is about one-half of the full pressure differential across the valve, i.e. between vacuum channel section 25 and the plenum 19. As with the preferred embodiment control valve, plenum vacuum would overcome the spring bias and hold the poppet type valve closed until a moving sheet travels over the vacuum channel section a sufficient distance to provide a vacuum pressure in the channel section sufficient to reduce the pressure differential across the valve, thereby permitting the biasing spring to begin to open the same. Thereafter, plenum vacuum would communicate with the vacuum channel section, further reducing the pressure differential across the valve and supplying full plenum vacuum to hold the sheet on the conveyor belts.

What is claimed is:

1. A sheet-actuated vacuum assisted sheet conveyor for the continuous transfer of sheets delivered in serial spaced relation, said conveyor comprising:

a pair of laterally spaced, parallel driven flat coplanar conveyor belts operating over a flat surface of a vacuum plenum, the flat plenum surface between the belts recessed from the coplanar flat belts to define a shallow vacuum channel;

a plurality of vacuum control valves in said flat surface spaced in a direction of conveyor belt movement and providing vacuum communication between the plenum and the vacuum channel;

said control valves operative to be held closed in the absence of a sheet on the conveyor, by a negative pressure in the plenum sufficient to create a first pressure differential across the valves, said valves including means for biasing the valves to open for vacuum communication at a second pressure differential across the valves less than the first pressure differential;

means for moving sheets into planar contact with the conveyor belts in a manner that progressively covers said vacuum channel; and, means for applying plenum vacuum to an upstream end of the vacuum channel upstream of the upstreammost valve such that, as a sheet moves to progressively cover said vacuum channel, vacuum pressure in the channel moves in a downstream direction with the sheet to cause the first pressure differential across each valve in succession to decrease to said second pressure differential and said valves to serially open, thereby applying the plenum vacuum directly to the sheet to hold the same against and to move with the conveyor belts.

2. The apparatus as set forth in claim 1 wherein said vacuum control valves each comprise:

a vacuum opening in the flat surface of the vacuum channel; and, a valve plate attached to the plenum surface and operative to seal the vacuum opening against a valve bias at said first pressure differential.

3. The apparatus as set forth in claim 2 wherein the valve plate of each valve comprises a thin spring steel plate attached at one edge to the flat surface and permanently bent along a hinge line to define a flat body portion extending away from the flat surface at an acute angle when the valve is open.

4. The apparatus as set forth in claim 1 wherein the means for applying plenum vacuum to the upstream end of the vacuum channel comprises a vacuum starter opening in the flat surface.

5. The apparatus as set forth in claim 4 comprising a plurality of laterally adjacent vacuum channels operatively connected to the vacuum plenum, each channel providing support for an incremental width of a sheet.

6. The apparatus as set forth in claim 5 wherein a vacuum inlet opening of each of the vacuum channels is connected by a starter vacuum conduit to a laterally adjacent vacuum channel such that plenum vacuum pressure in said laterally adjacent channel, when the control valve for the channel to which said laterally adjacent channel is connected is open, is communicated to the starter opening of said laterally adjacent channel.

7. The apparatus as set forth in claim 6 wherein each starter vacuum conduit includes a vacuum inlet end in the flat plenum surface of the directly adjacent vacuum channel.

8. The apparatus as set forth in claim 6 comprising a vacuum starter opening in each of a selected number of non-adjacent channels and a starter vacuum conduit operatively connecting each of the vacuum starter openings in each of said selected non-adjacent channels with a serially adjacent vacuum channel between said selected non-adjacent channel and the next selected non-adjacent channel.

9. A self-valving vacuum distribution system for a belt-driven sheet transfer apparatus comprising:

a vacuum plenum having a flat surface over which a pair of spaced conveyor belts operate to define an open vacuum channel; and, vacuum control valves spaced along the channel in the flat plenum surface, said valves held closed by a high pressure differential between the vacuum plenum and the open vacuum channel and biased to open under a reduced pressure differential between the vacuum plenum and the vacuum channel, the reduced pressure differential provided by a plenum vacuum connection, including a vacuum starter opening in the plenum surface upstream of the control valves providing initial vacuum communication between the plenum and the upstream end of the vacuum channel when the channel is covered by a sheet carried over the channel on the conveyor belts, the open vacuum channel permitting the plenum vacuum to move downstream as the channel is covered;

an infeed device adapted to move a line of spaced sheets in series into contact with the conveyor belts and to cause a leading edge of each sheet to override the vacuum starter opening and each control valve in succession;

each of said control valves including a flat resilient metal plate operatively connected by an edge to the plenum flat surface, said plate having a closure face bent away at an acute angle from the plane of the flat surface to provide the bias to open at said reduced pressure differential; and, a vacuum opening in the plenum flat surface providing vacuum communication between the plenum and the vacuum channel, said vacuum opening aligned with the valve plate and closed thereby at said high pressure differential.

* * * * *